US006327714B1

(12) United States Patent
Koerner

(10) Patent No.: US 6,327,714 B1
(45) Date of Patent: Dec. 11, 2001

(54) CLOTHING ASSEMBLY

(76) Inventor: Gregory Alan Koerner, 2712 Westview, Dodge City, KS (US) 67801

( * ) Notice: Subject to any disclaimer, the term of this patent is extended or adjusted under 35 U.S.C. 154(b) by 0 days.

(21) Appl. No.: 09/472,739

(22) Filed: Dec. 27, 1999

(51) Int. Cl.[7] ..... A41F 9/00; A41D 1/06

(52) U.S. Cl. ..... 2/236; 2/227; 2/79; 2/311

(58) Field of Search ..... 2/236, 338, 219, 2/220, 221, 227, 235, 237, 308, 315, 316, 317, 321, 322, 326, 328, 329; D2/627, 634

(56) References Cited

U.S. PATENT DOCUMENTS

| | | | | |
|---|---|---|---|---|
| 464,916 | * | 12/1891 | Taylor | 2/338 |
| 1,107,158 | * | 8/1914 | Day | 2/227 |
| 1,257,856 | * | 2/1918 | Haun | 2/338 |
| 1,830,302 | * | 11/1931 | Townsend | 2/338 |
| 3,007,175 | * | 11/1961 | Robson | 2/221 |
| 3,950,791 | * | 4/1976 | Domenech | 2/236 |
| 4,188,672 | * | 2/1980 | Kalso | 2/221 |
| 4,726,077 | * | 2/1988 | Batiste | 2/321 |
| 4,985,937 | * | 1/1991 | Blackburn | 2/312 |
| 5,226,195 | * | 7/1993 | Pappas, Jr. | 2/338 |
| 5,351,340 | * | 10/1994 | Aldridge | 2/108 |
| 5,689,832 | * | 11/1997 | Head | 2/227 |
| 5,819,320 | * | 10/1998 | Jolla | 2/236 |
| 5,881,392 | * | 3/1999 | Koerner et al. | 2/227 |

* cited by examiner

*Primary Examiner*—John J. Calvert
*Assistant Examiner*—Alissa L. Hoey
(74) *Attorney, Agent, or Firm*—Kenneth H. Jack; Davis & Jack, L.L.C.

(57) ABSTRACT

A clothing assembly consisting of trousers, the trousers having a waist, the waist having a waistband, the waistband having a right side, a left side, a front side, and a back side; a plurality of upper belt loops, each belt loop among said plurality being fixedly attached to the waistband; a plurality of lower belt loops, each belt loop among said plurality being fixedly attached to the waistband; and a flexible belt positioned to form a figure eight, the figure eight comprising an upper loop, a lower loop, and a crossover, the upper loop of the figure eight extending through the upper belt loops, the lower loop of the figure eight extending through the lower belt loops, the crossover overlying the right side of the waistband.

4 Claims, 2 Drawing Sheets

44
20
36
38
42
16
40
2
10
18
24
12
14
22
1
4
6
8

34
36
20
38
16
2
30
28
26
32
4
1
8
6

CLOTHING ASSEMBLY

FIELD OF THE INVENTION

This invention relates to clothing. Particularly, this invention relates to trousers and belt combinations. More particularly, this invention relates to novel assemblies of trousers and belts.

BACKGROUND OF THE INVENTION

Fashionable women's apparel, clothing and accessories commonly are tailored or designed so that they display various stylistic or fashionable lines. As an example, women who wear blouses or dresses having a bateau neck display stylistic horizontal necklines which extend from the top of the left shoulder to the top of the right shoulder. Bateau neck blouses worn in coordination with a yoke skirt create additional horizontal lines displayed at the waistline and hipline. Another example of display by women's clothing or apparel of stylistic lines is a women's draped necked dress or blouse which displays a series of concentric curved lines at the neckline. Another example is the diagonally angled lines of a women's dress having a plunging neckline, or the crossing diagonal lines of a women's wrap around dress. A further example of diagonally crossing stylistic clothing lines is taught by the Clothing Assembly of U.S. Pat. No. 5,881,392 issued Mar. 16, 1997 to Greg Koerner, et al.

Several common items of clothing or apparel worn by both men and women perform a primary utilitarian function, and perform a secondary stylistic line displaying function; the secondary function being dictated, sometimes undesirably by the primary function. For example, the primary utilitarian function of the hatband of a hat is prevention of outward stretching of the hat; the secondary function of the hatband being display of a stylistic horizontal line. The horizontal line of the hatband follows and is integral to its utilitarian function. Similarly, the brim of a lady's hat commonly displays a stylistic horizontal line while shading the wearer's face, the shade being the primary function of the brim and the horizontal stylistic line being secondary. Another common example of such primary and secondary functions is suspenders which display stylistic vertical lines while performing their primary utilitarian function of trouser suspension. Similarly, a common belt which, when worn in combination with common trousers, primarily functions to mechanically suspend trousers in proper wearing position, and secondarily functions to display a stylistic horizontal line. In order for a common belt to properly perform its mechanical trouser supporting function, it is sometimes necessary that the belt have a width of ¾ inches or greater, such enhanced width preventing the belt from undesirably gouging into the waist of the wearer. However, it is often undesirable for a woman to display a thick or wide stylish line at the waist. In each of the above examples, including the wide belt example, the secondary stylistic function is potentially undesirably dictated by the primary utilitarian function of the clothing item.

The instant invention provides a solution where the above described problem arises in relation to belts and trousers by providing a novel trouser, belt and belt loop assembly. The inventive assembly allowing a women's belt to perform trouser suspension as capably as a common wide belt while desirably performing the secondary function of displaying narrow rather than wide stylistic horizontal lines at the waist.

BRIEF SUMMARY OF THE INVENTION

The instant inventive clothing assembly preferably comprises a pair of lady's trousers, and a long or double length flexible leather belt having a width preferably between ⅜ inch and ½ inch. Preferably, the trousers have a wide waistband. However, the inventive assembly is equally applicable to trousers which have a narrow waist band or no waist band at all. Necessarily, the trousers have a plurality of upper belt loops and a plurality of lower belt loops spaced around the waistband or waist of the trousers as the case may be. Preferably, the upper belt loops comprise a front upper right belt loop, a front upper left belt loop, a rear upper right belt loop, and a rear upper left belt loop; the front upper right and front upper left belt loops being positioned respectively to the left and to the right of the fly, if any, of the trousers. Preferably, the plurality of lower belt loops similarly comprises a front lower right belt loop, a front lower left belt loop, a rear lower right belt loop, and a rear lower left belt loop; the front lower right and front lower left belt loops being positioned respectively to the left and to the right of the fly, if any, of the trousers. Preferably, the upper belt loops and the lower belt loops are vertically spaced with respect to each other so that all, or at least the majority, of the vertical length of each upper belt loop overlies the upper ends of the lower belt loops.

Preferably, a crossover belt loop is fixedly attached to the right side of the trousers upon its waist or waistband, as the case may be. Alternately and suitably, the crossover belt loop may be positioned upon the left side of the trousers, overlying its waist or waistband, as the case may be.

Assembly of the invention entails extension and positioning of the flexible belt through the upper and lower belt loops so that the belt forms a figure eight having an upper loop, a lower loop, and a crossover; the upper loop extending through the upper belt loops, the lower loop extending through the lower belt loops, and the crossover extending through the crossover belt loop. Preferably, the belt has a buckle, the belt preferably being buckled between the front upper right and front upper left belt loops.

Suitably, though less desirably, the crossover belt loop may be omitted, allowing the figure eight crossover of the belt to simply overlie the right or left side of the waistband or waist of the trousers, as the case may be.

Upon assembly of the inventive clothing assembly, the belt performs a primary trouser suspending function as capably and efficiently as a much wider belt, avoiding gouging into the waist of a wearer, while secondarily fashionably displaying narrow horizontal lines at the wearer's waist.

Accordingly, it is an object of the present invention to provide a belt and trouser assembly capable of efficiently suspending trousers without gouging into a wearer's waist while simultaneously displaying narrow stylistic horizontal lines at the wearer's waistline.

Other and further objects, benefits, and advantages of the present invention will become known to those skilled in the art upon review of the Detailed Description which follows, and upon review of the appended drawings.

BRIEF DESCRIPTION OF THE DRAWINGS

Drawing

Drawing

DETAILED DESCRIPTION OF THE PREFERRED EMBODIMENT

Figure 1:
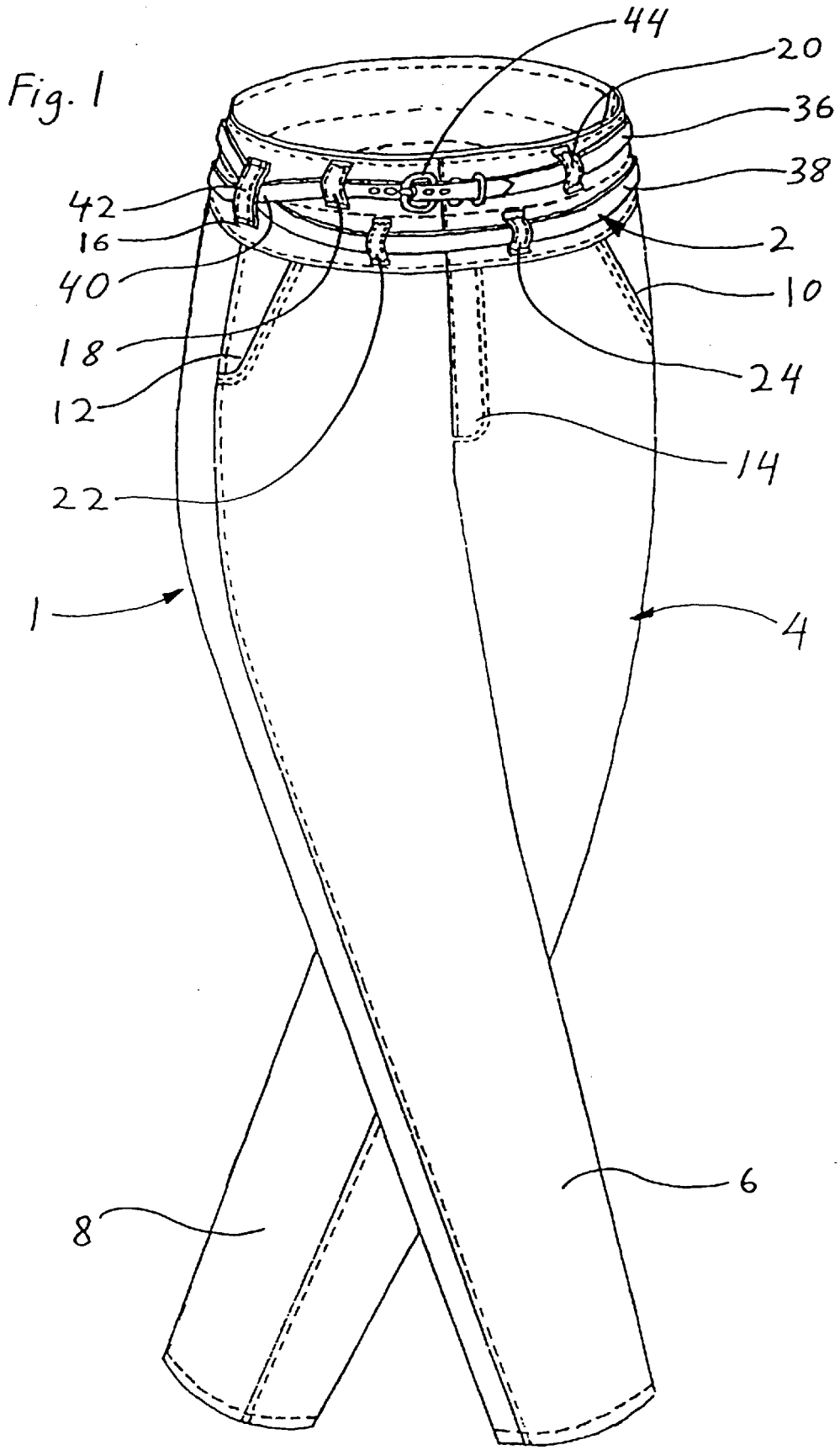
FIG. 1 is a front perspective view of the present inventive clothing assembly.

Referring now to the drawings, and in particular to FIG. 1, the present inventive clothing assembly is referred to generally by reference arrow 1. A major structural element of the inventive assembly 1 is a flexible belt referred to by reference arrow 2, the belt 2 preferably being composed of leather. Preferably, the belt 2 has a width between ⅜ inch and ½ inch. The length of the belt necessarily varies depending upon the waist size of the wearer. For example, a wearer having a twenty-four inch waist would utilize a belt having a length of approximately fifty-four inches.

Figure 2:
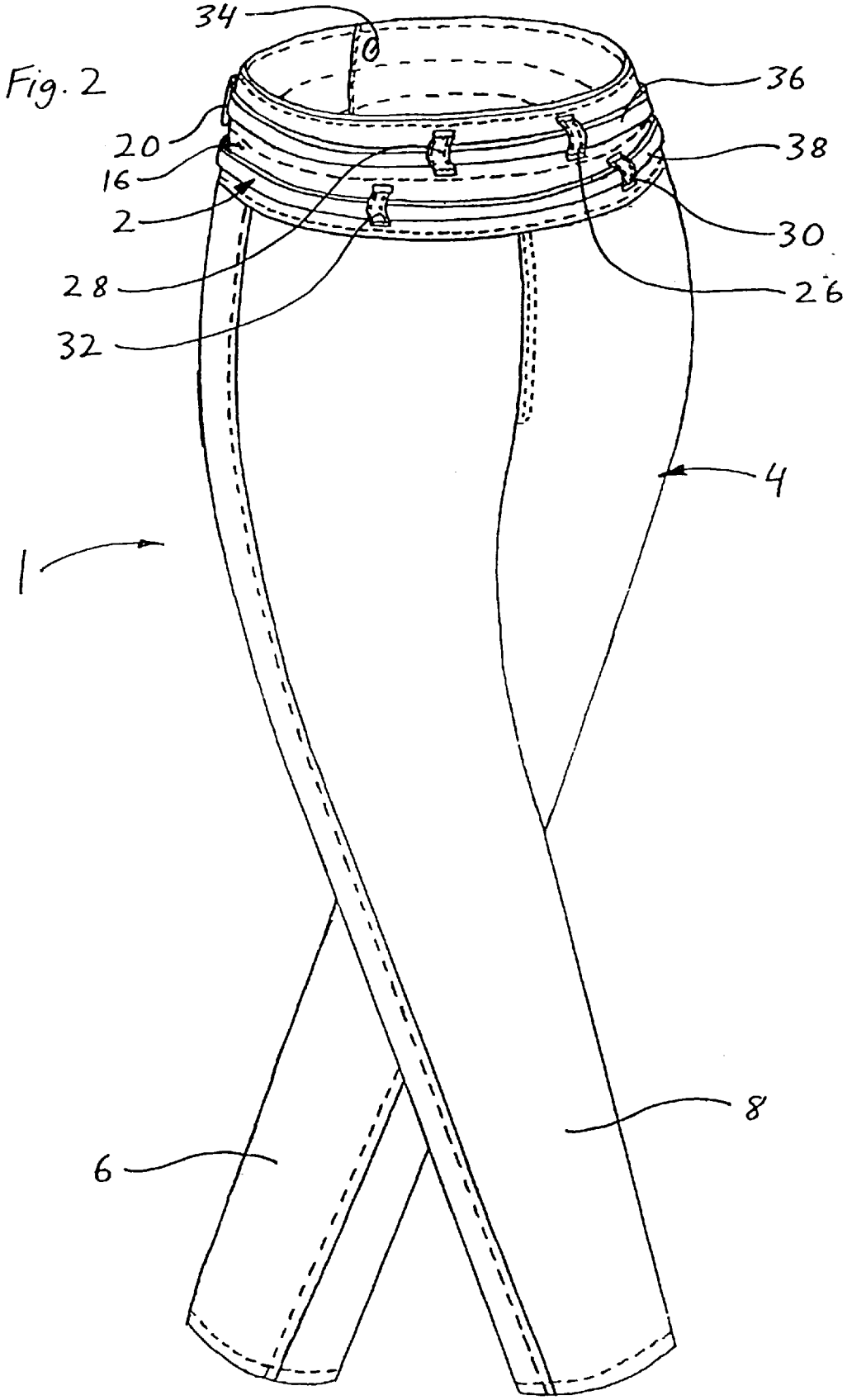
FIG. 2 is a rear perspective view of the present inventive clothing assembly.

A second major structural element of the inventive assembly 1 are trousers referred to generally by reference arrow 4, the trousers 4 preferably having a right leg 6, a left leg 8, left and right pockets 10 and 12, a zippered fly 14, and a wide waistband 16, and, referring to FIG. 2, a snap 34 at the top of the fly. Alternately and suitably, the trousers 4 may be of a type having a standard narrow waistband, or no waistband.

Referring simultaneously to FIGS. 1 and 2, it is preferable that the trousers 4 have a plurality of upper belt loops and a plurality of lower belt loops, the upper belt loops preferably consisting of an upper front right belt loop 18, an upper front left belt loop 20, a lower front right belt loop 22, a lower front left belt loop 24, an upper rear right belt loop 26, an upper rear left belt loop 28, a lower rear right belt loop 30, and a lower rear left belt loop 32.

Referring further simultaneously to FIGS. 1 and 2, the belt 2 is bendably positioned and extended into a figure eight whose loops are displaced toward each other. An upper loop 36 of the figure eight preferably extends through the upper belt loops 18, 20, 26, and 28; while the lower loop 38 of the figure eight extends through the lower belt loops 22, 24, 30 and 32. Where the trousers 4 include a crossover belt loop 42, it is preferable that the crossover 40 of the figure eight extend through such belt loop. Suitably, both the crossover 40 of the figure eight and the crossover belt loop 42 may be alternately situated on the left side of the trousers. Also suitably, but less desirably, the crossover belt loop 42 may be omitted, allowing the crossover 40 of the figure eight to simply overlie the left or right side of the waistband 16, or waist, as the case may be.

Preferably, the belt 2 has a buckle 44, which preferably adjustably attaches the ends of the belt 2; the buckle 44, upon assembly, preferably being situated between the upper front Right and left belt loops 18 and 20.

The inventive assembly 1 as depicted in FIGS. 1 and 2 provides contact area approximately equal to that provided by a much wider belt. Thus, the assembly prevents gouging of a wearer's waist as capably as such wider belt. However, unlike such wider belt, the inventive assembly 1 performs the additional function of displaying stylistic narrow horizontal lines at the wearer's waist.

While the principles of the invention have been made clear in the above illustrative embodiments, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A clothing assembly comprising:

(a) trousers, the trousers having a waist, the waist having a waistband, the waistband having a right side, a left side, a front side, and a back side;

(b) a plurality of upper belt loops, each belt loop among said plurality being fixedly attached to the waistband;

(c) a plurality of lower belt loops, each belt loop among said plurality being fixedly attached to the waistband;

(d) a flexible belt positioned to form a figure eight, the figure eight comprising an upper loop, a lower loop, and a crossover, the upper loop of the figure eight extending through the upper belt loops, the lower loop of the figure eight extending through the lower belt loops, the crossover overlying the right side of the waistband; and, (e) a crossover belt loop fixedly attached to the right side of the waistband, the crossover of the figure eight extending through the crossover belt loop, the plurality of upper belt loops comprising an upper front right belt loop and an upper front left belt loop, the flexible belt having a buckle, the flexible belt being buckled between the upper front right and upper front left belt loops, the lower plurality of belt loops comprising a lower front left belt loop and a lower front right belt loop, the plurality of upper belt loops further comprising an upper rear right belt loop and an upper rear left belt loop, the plurality of lower belt loops further comprising a lower rear right belt loop and a lower rear left belt loop.

2. A clothing assembly comprising:

(a) trousers, the trousers having a waist, the waist having a waistband, the waistband having a right side, a left side, a front side, and a back side;

(b) a plurality of upper belt loops, each belt loop among said plurality being fixedly attached to the waistband;

(c) a plurality of lower belt loops, each belt loop among said plurality being fixedly attached to the waistband;

(d) a flexible belt positioned to form a figure eight, the figure eight comprising an upper loop, a lower loop, and a crossover, the upper loop of the figure eight extending through the upper belt loops, the lower loop of the figure eight extending through the lower belt loops, the crossover overlying the left side of the waistband; and, (e) a crossover belt loop fixedly attached to the left side of the waistband, the crossover of the figure eight extending through the crossover belt loop, the plurality of upper belt loops comprising an upper front right belt loop and upper front left belt loop, the flexible belt having a buckle, the flexible belt being buckled between the upper front right and upper front left belt loops, the lower plurality of belt loops comprising a lower front left belt loop and a lower front right belt loop, the lower plurality of belt loops comprising a lower front left belt loop and a lower front right belt loop, the plurality of upper belt loops further comprises an upper rear right belt loop and an upper rear left belt loop, the plurality of lower belt loops further comprising a lower rear right belt loop and a lower rear left belt loop.

3. A clothing assembly comprising:

(a) trousers, the trousers having a waist, the waist having a right side, a left side, a front side, and a back side;

(b) a plurality of upper belt loops fixedly attached to the waist;

(c) a plurality of lower belt loops fixedly attached to the waist;

(d) a flexible belt positioned to form a figure eight, the figure eight comprising an upper loop, a lower loop, and a crossover, the upper loop of the figure eight extending through the upper belt loops, the lower loop of the figure eight extending through the lower belt loops, the crossover overlying the right side of the waist; and, (e) a crossover belt loop fixedly attached to the right side of the waist, the crossover of the figure eight extending through the crossover belt loop, the plurality of upper belt loops comprising an upper front right belt loop and upper front left belt loop, the flexible belt having a buckle, the flexible belt being buckled between the upper front right and upper front left belt loops; the lower plurality of belt loops comprises a lower front left belt loop and a lower front right belt loop, the plurality of upper belt loops further comprising an upper rear right belt loop and an upper rear left belt loop, the plurality of lower belt loops further comprising a lower rear right belt loop and a lower rear left belt loop.

4. A clothing assembly comprising:

(a) trousers, the trousers having a waist, the waist having a right side, a left side, a front side, and a back side;

(b) a plurality of upper belt loops fixedly attached to the waist;

(c) a plurality of lower belt loops fixedly attached to the waist;

(d) a flexible belt positioned to form a figure eight, the figure eight comprising an upper loop, a lower loop, and a crossover, the upper loop of the figure eight extending through the upper belt loops, the lower loop of the figure eight extending through the lower belt loops, the crossover overlying the left side of the waist; and, (e) a crossover belt loop fixedly attached to the right side of the waist, the crossover underlying the crossover belt loop; the plurality of upper belt loops comprising an upper front right belt loop and upper front left belt loop, the flexible belt having a buckle, the flexible belt being buckled between the upper front right and upper front left belt loops, the lower plurality of belt loops comprising a lower front left belt loop and a lower front right belt loop, the plurality of upper belt loops further comprising an upper rear right belt loop and an upper rear left belt loop, the plurality of lower belt loops further comprising a lower rear right belt loop and a lower rear left belt loop.

* * * * *

UNITED STATES PATENT AND TRADEMARK OFFICE

CERTIFICATE OF CORRECTION

PATENT NO. : 6,327,714 B1
DATED : December 11, 2001
INVENTOR(S) : Gregory A. Koerner It is certified that error appears in the above-identified patent and that said Letters Patent is hereby corrected as shown below:

Column 1,
Line 26, "March 16, 1997" should read -- Mar. 16, 1999 --.

Signed and Sealed this

Twenty-ninth Day of October, 2002

*Attest:*

*Attesting Officer*

JAMES E. ROGAN
*Director of the United States Patent and Trademark Office*